US009799244B1

(12) United States Patent
Key et al.

(10) Patent No.: US 9,799,244 B1
(45) Date of Patent: Oct. 24, 2017

(54) VEHICLE DISPLAY DEVICE

(71) Applicant: D2 AUTO GROUP, LLC, Houston, TX (US)

(72) Inventors: David Key, Houston, TX (US); Dan Matheus, Fort Worth, TX (US)

(73) Assignee: D2 AUTO GROUP, LLC, Houston, TX (US)

( * ) Notice: Subject to any disclaimer, the term of this patent is extended or adjusted under 35 U.S.C. 154(b) by 164 days.

(21) Appl. No.: 14/802,516

(22) Filed: Jul. 17, 2015

Related U.S. Application Data

(60) Provisional application No. 62/026,462, filed on Jul. 18, 2014.

(51) Int. Cl.

| | |
|---|---|
| ***G09F 19/02*** | (2006.01) |
| ***B66F 7/16*** | (2006.01) |
| ***B66F 7/28*** | (2006.01) |
| ***G09F 9/33*** | (2006.01) |

(52) U.S. Cl.
CPC ..... *G09F 19/02* (2013.01); *B66F 7/16* (2013.01); *B66F 7/28* (2013.01); *G09F 9/33* (2013.01)

(58) Field of Classification Search
CPC ..... B60P 3/0255; G09F 19/02; G09F 9/33; G09F 21/04; G09F 21/048; B66F 7/16
See application file for complete search history.

(56) References Cited

U.S. PATENT DOCUMENTS

| | | | | |
|---|---|---|---|---|
| 2,945,551 | A | 7/1960 | Annin et al. | |
| 3,117,652 | A * | 1/1964 | Wallace | B66F 7/02 187/213 |
| 3,168,206 | A | 2/1965 | Washington | |
| 3,820,631 | A | 6/1974 | King et al. | |
| 3,931,895 | A | 1/1976 | Grimaldo | |
| 4,171,120 | A | 10/1979 | Clark | |
| 4,724,875 | A | 2/1988 | Baldwin et al. | |
| 4,746,262 | A | 5/1988 | Anderson | |
| 4,921,305 | A | 5/1990 | Steer | |
| 5,169,226 | A | 12/1992 | Friedman | |
| 5,575,591 | A | 11/1996 | Vanderklaauw | |
| 5,803,279 | A | 9/1998 | Stallbaumer et al. | |
| 6,027,290 | A * | 2/2000 | Andre | B60P 1/02 187/215 |
| 6,485,237 | B1 * | 11/2002 | Sandwith | B60P 3/08 410/24 |
| 7,004,286 | B2 | 2/2006 | Fredette | |
| 7,552,683 | B2 | 6/2009 | Hayashi | |
| 7,942,461 | B2 | 5/2011 | Cohen et al. | |
| 8,418,386 | B1 * | 4/2013 | Key | G09F 21/04 296/21 |
| 2002/0148683 | A1 | 10/2002 | Donaldson et al. | |
| 2002/0182026 | A1 | 12/2002 | Sandwith | |
| 2003/0138309 | A1 | 7/2003 | Kozak | |

(Continued)

*Primary Examiner* — Gary C Hoge
(74) *Attorney, Agent, or Firm* — Buskop Law Group, P.C.; Wendy Buskop

(57) ABSTRACT

A vehicle display device and method for elevating and rotating a vehicle configured to fit in a single car parking space, while simultaneously displaying messages through a connected electronic message display. The vehicle display device has a turntable allowing for three hundred and sixty degrees of rotation of the vehicle. The electronic message display can present multiple messages that are customizable and easily modified.

13 Claims, 7 Drawing Sheets

(56) References Cited

U.S. PATENT DOCUMENTS

| | | | | |
|---|---|---|---|---|
| 2004/0197176 | A1* | 10/2004 | Pate | B60P 1/02 414/495 |
| 2005/0173601 | A1* | 8/2005 | Hestand | B60P 3/0255 248/129 |
| 2005/0210722 | A1 | 9/2005 | Graef et al. | |
| 2007/0045046 | A1 | 3/2007 | Hayes | |
| 2008/0008552 | A1 | 1/2008 | Boydstun et al. | |
| 2008/0149420 | A1 | 6/2008 | Cheatham | |
| 2009/0321189 | A1* | 12/2009 | Schmitt | B66F 7/04 187/215 |
| 2010/0066278 | A1* | 3/2010 | De Jong | B66F 7/16 318/376 |
| 2010/0283889 | A1* | 11/2010 | Johnson | G09F 19/18 348/370 |

* cited by examiner

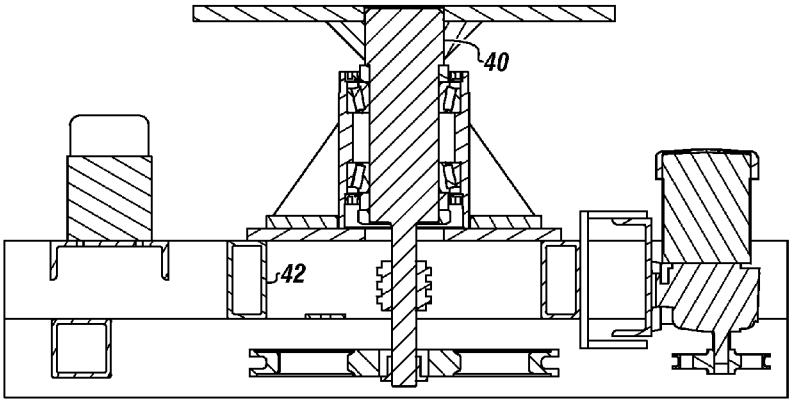
FIGURE 4
FIGURE 5
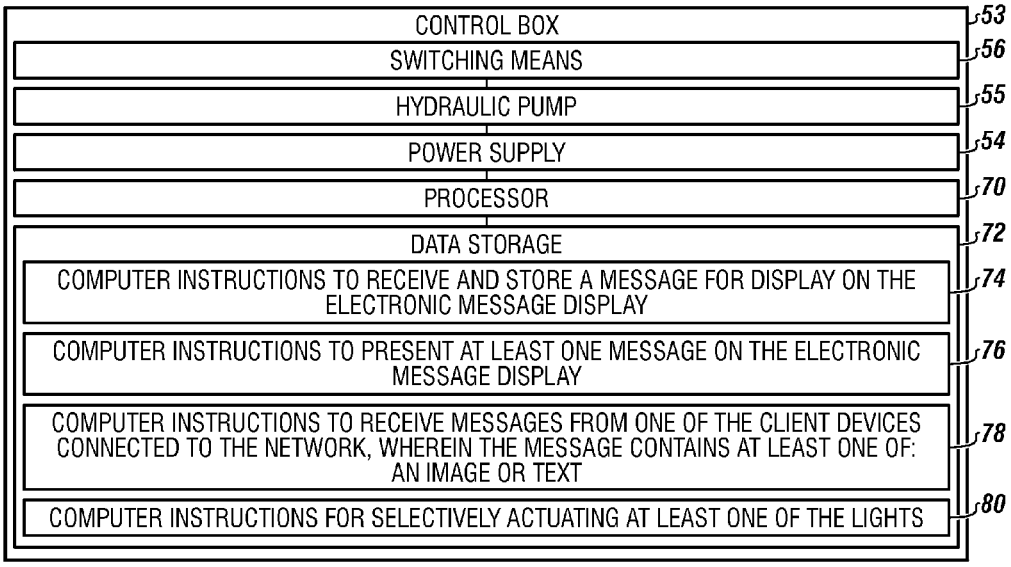

VEHICLE DISPLAY DEVICE

CROSS REFERENCE TO RELATED APPLICATION

The current application claims priority to and the benefit of U.S. Provisional Patent Application Ser. No. 62/026,462 filed Jul. 18, 2014, entitled "VEHICLE DISPLAY DEVICE". This reference is hereby incorporated in its entirety.

FIELD

The present embodiments generally relate to a mobile vehicle display device with an electronic message display.

BACKGROUND

A need exists for a vehicle display device that can be easily transported and used to display a vehicle.

A further need exists for a vehicle display device that can display one or more banners, signs or other objects along with the vehicle.

A further need exists for a vehicle display device that can display customizable and easily modifiable electronic message display for presenting multiple messages.

The present embodiments meet these needs.

BRIEF DESCRIPTION OF THE DRAWINGS

The detailed description will be better understood in conjunction with the accompanying drawings as follows:

FIG. 4 depicts a cross sectional view of a turntable.

FIG. 5 depicts a diagram of a control box.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

A benefit of the vehicle display device is that it requires less than a quarter of an ampere to operate, saving precious natural resources through the conservation of energy.

The vehicle display device provides higher safety standards for means of display as well as safer operating procedures for those operating the device.

The vehicle display device provides a way to present vehicles in a safer manner as it can be used in extremely inclimate weather conditions, such as high winds, heavy rain, and other storm like environments.

The vehicle display device is unique in that it has a zero carbon footprint and will not negatively impact the environment.

The electronic message display of the invention can utilize low wattage lighting technology to present public display messages regarding various safety messages, such as missing persons, parking information, safety information, and the like, all whilst utilizing low-wattage technology.

The vehicle display device can be easily transported, making it a mobile vehicle display device.

Figure 1A:
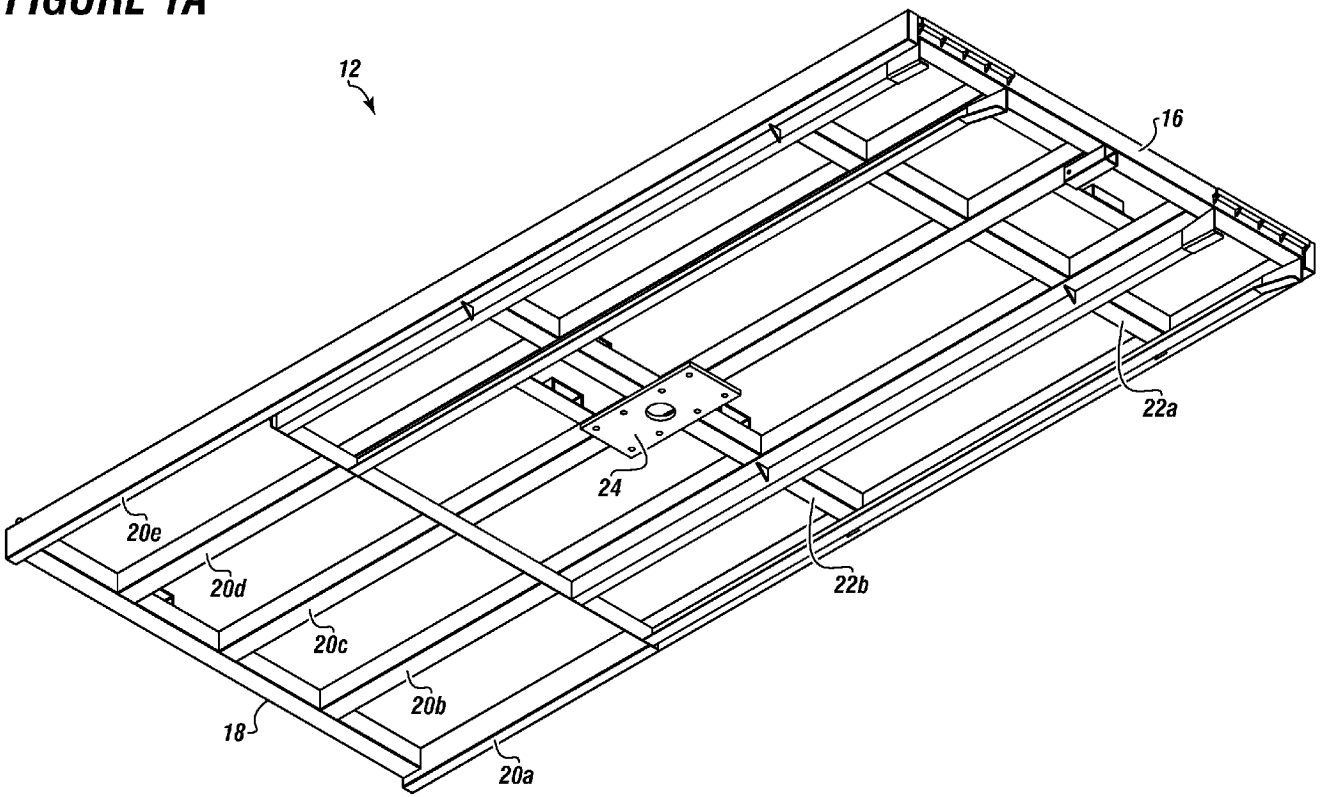
FIG. 1A depicts a bottom perspective view of a frame assembly top.

Turning now to the Figures, FIG. 1A depicts a bottom perspective view of a frame assembly top.

The frame assembly top 12 can be a portion of the vehicle display device. The frame assembly top, in embodiments, can have a length from 13 feet to 16 feet and a width from 5 feet to 10 feet.

The frame assembly top 12 can have a plurality of longitudinal top supports 20*a*-20*e* connected between a first end member 16 and a second end member 18. Each of the longitudinal top supports can have a length that is identical with the other longitudinal top supports, and can be long enough to support a vehicle that will be supported by the frame assembly top. From 3 to 9 longitudinal top supports can be used.

The plurality of longitudinal top supports can be made from tubular steel. In embodiments, the longitudinal top supports can be channel steel, having a width from 1 inch to 4 inches.

The frame assembly top 12 can have a plurality of traverse top supports 22*a* and 22*b* extending across the plurality of longitudinal top supports. In embodiments, the traverse top supports can be welded to the longitudinal top supports. In embodiments, the traverse top supports can create a rectangular shape with the plurality of longitudinal top supports. From 1 to 12 traverse top supports can be used.

In embodiments, the traverse top supports can be made from channel steel having a width from 1 inch to 4 inches. In embodiments, the traverse top supports can be small pieces of steel positioned and welded between the longitudinal top supports connecting at a 90 degree angle to the longitudinal top supports.

A top frame plate 24 can be attached to a longitudinal top support 20*c*. In embodiments, the top frame plate 24 can be mounted between a traverse top support 22*b* and a longitudinal top support 20*c*.

In embodiments, the top frame plate can be plate steel with a thickness from 1 inch to 3 inches, a length from 18 inches to 36 inches, and a width from 4 inches to 24 inches. In embodiments, the top frame plate can be rectangular in shape. In embodiments, the top frame plate can be made from a reinforced metal. In embodiments, the top frame plate can be welded or bolted to the longitudinal top supports and the transverse top supports.

Figure 1B:
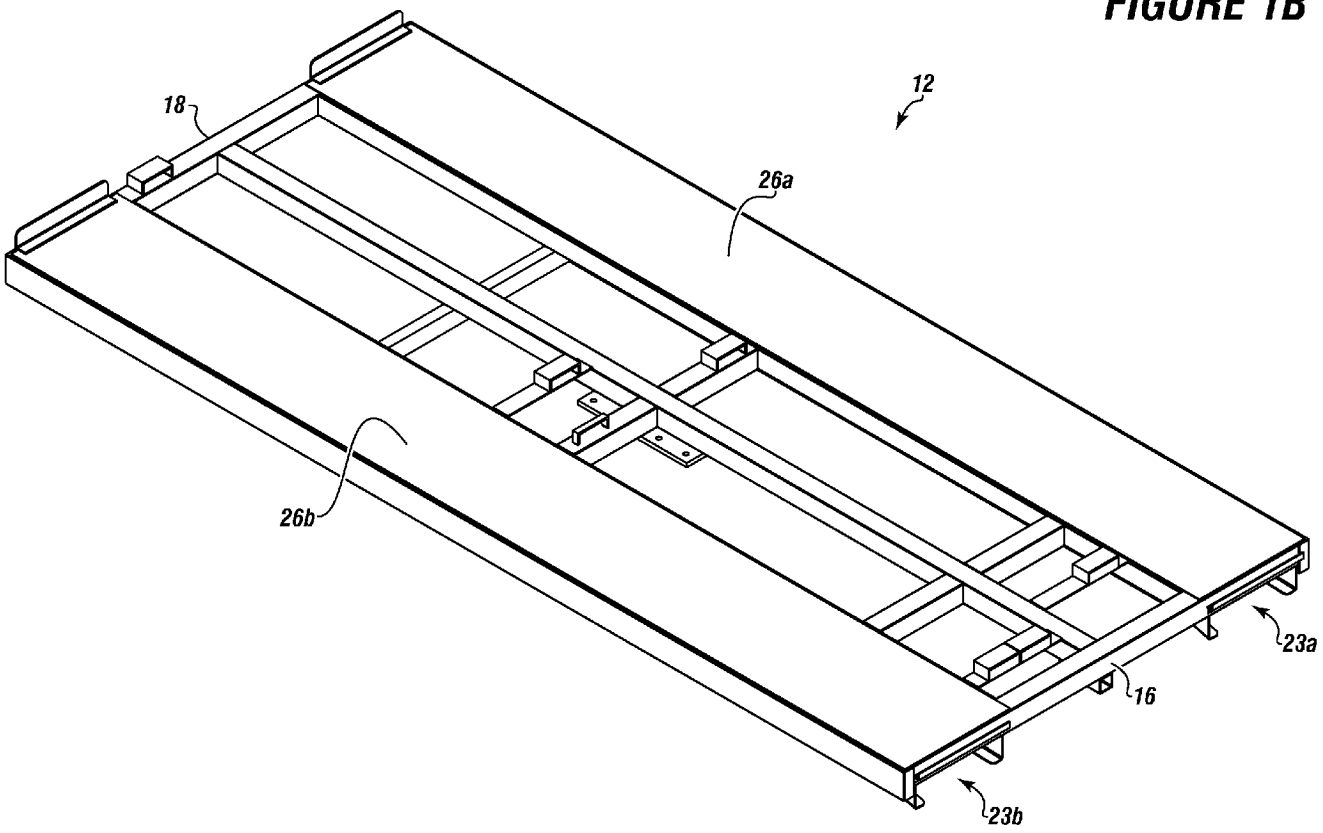
FIG. 1B depicts a top perspective view of the frame assembly top.

FIG. 1B depicts a top perspective view of the frame assembly top.

The frame assembly top 12 can include a pair of vehicle pads 26*a* and 26*b* mounted between the first end member 16 and the second end member 18. The vehicle pads can be mounted over and in parallel with the plurality of longitudinal top supports as well as and over the plurality of traverse top supports. In embodiments, the vehicle pads can be welded to all of the traverse top support members and between pairs of the longitudinal top supports.

Each vehicle pad can have a width from 12 inches to 48 inches and a length from 4 feet to 16 feet. In embodiments, the vehicle pads can extend beyond the longitudinal top supports. In an embodiment, the pair of vehicle pads can be a single plate.

In embodiments, the vehicle pads 26*a* and 26*b* can each have a channel 23*a* and 23*b* under each vehicle pad for supporting individual car wheel ramps. Each car wheel ramp can be wide enough and long enough to sit in the channels. Each car wheel ramp can be made from steel that will not deform when a vehicle is driven on the individual car wheel ramps and onto the vehicle pads.

Both vehicle pads can support at least 500 pounds of vehicle and up to 10,000 pounds of vehicle without deforming, as the vehicle pads are supported by the plurality of longitudinal top supports with the plurality of traverse top supports. The vehicles can be cars, trucks, jeeps, all-terrain vehicles and boats on trailers.

Figure 2:
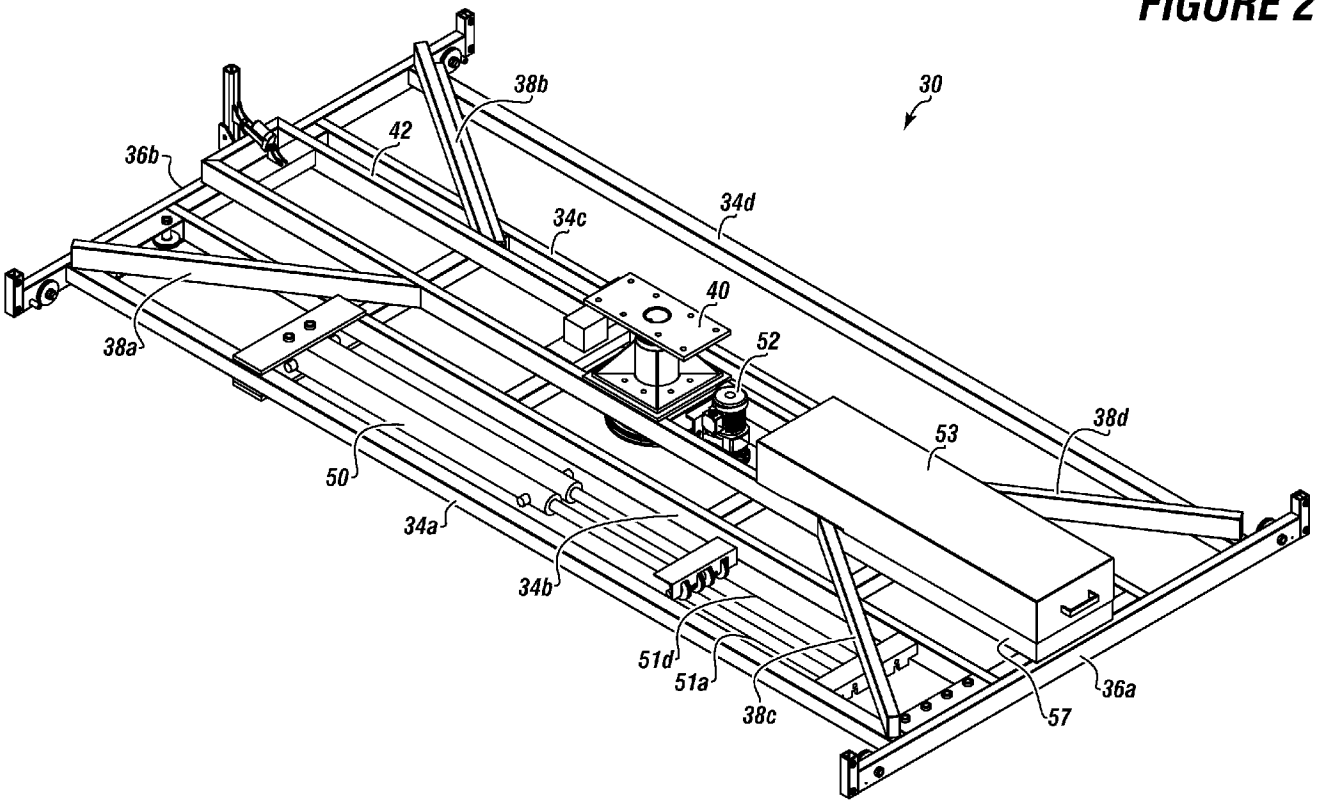
FIG. 2 depicts a top perspective view of a frame assembly bottom.

FIG. 2 depicts a top perspective view of a frame assembly bottom.

The frame assembly bottom 30 can have a plurality of longitudinal bottom supports 34*a*-34*d* mounted between a pair of traverse bottom supports 36*a* and 36*b*.

A frame 42 can be mounted between longitudinal bottom supports 34*c* and 34*b* and over the pair of traverse bottom supports 36*a* and 36*b*. In embodiments, the frame 42 can have a rectangular shape with sides identical in length to the longitudinal bottom supports.

The frame assembly bottom can have a plurality of diagonal supports 38*a*-38*d*. Each diagonal support can be connected between a longitudinal bottom support and the frame.

The frame 42 can support a turntable 40. The turntable 40 can securely engage and mount to the top frame plate of the frame assembly top.

The frame assembly bottom 30 can include a hydraulic lifting means 50, which can be a pair of pistons in embodiments. The hydraulic lifting means 50 can be mounted between a pair of longitudinal bottom supports 34*a* and 34*b*. The hydraulic lifting means 50 can be used for raising and lowering the frame assembly top apart from the frame assembly bottom between the legs of the device.

In embodiments, wherein the hydraulic lifting means 50 is a pair of pistons mounted between a pair of longitudinal bottom supports, the hydraulic lifting means can be used to pull in and release a plurality of cables 51*a*-51*d*. Each cable can be connected to a top of each leg of the device. Each cable can run between a plurality of pulleys secured to each leg allowing the plurality of cables to simultaneously raise and lower the frame assembly top between the plurality of legs when the pistons extend and retract.

The frame assembly bottom 30 can include a rotator 52 mounted on the frame 42. The rotator can electrically and mechanically rotate the turntable.

The frame assembly bottom 30 can include a control box 53 connected to the frame 42. A hydraulic reservoir 57 can be mounted underneath and fluidly connected to the control box 53.

The control box 53 can contain a power supply connected to a hydraulic pump. The hydraulic pump can receive fluid from the hydraulic reservoir 57. The power supply can also operate the rotator 52.

The control box 53 can also contain a switching means which can be electrically connected to the hydraulic pump and the rotator 52. In embodiments, the switching means can be a plurality of separate switches which are separately mounted to a surround member and connected to the power supply. In other embodiments, the switching means can be mounted to other elements of the device.

Figure 3A:
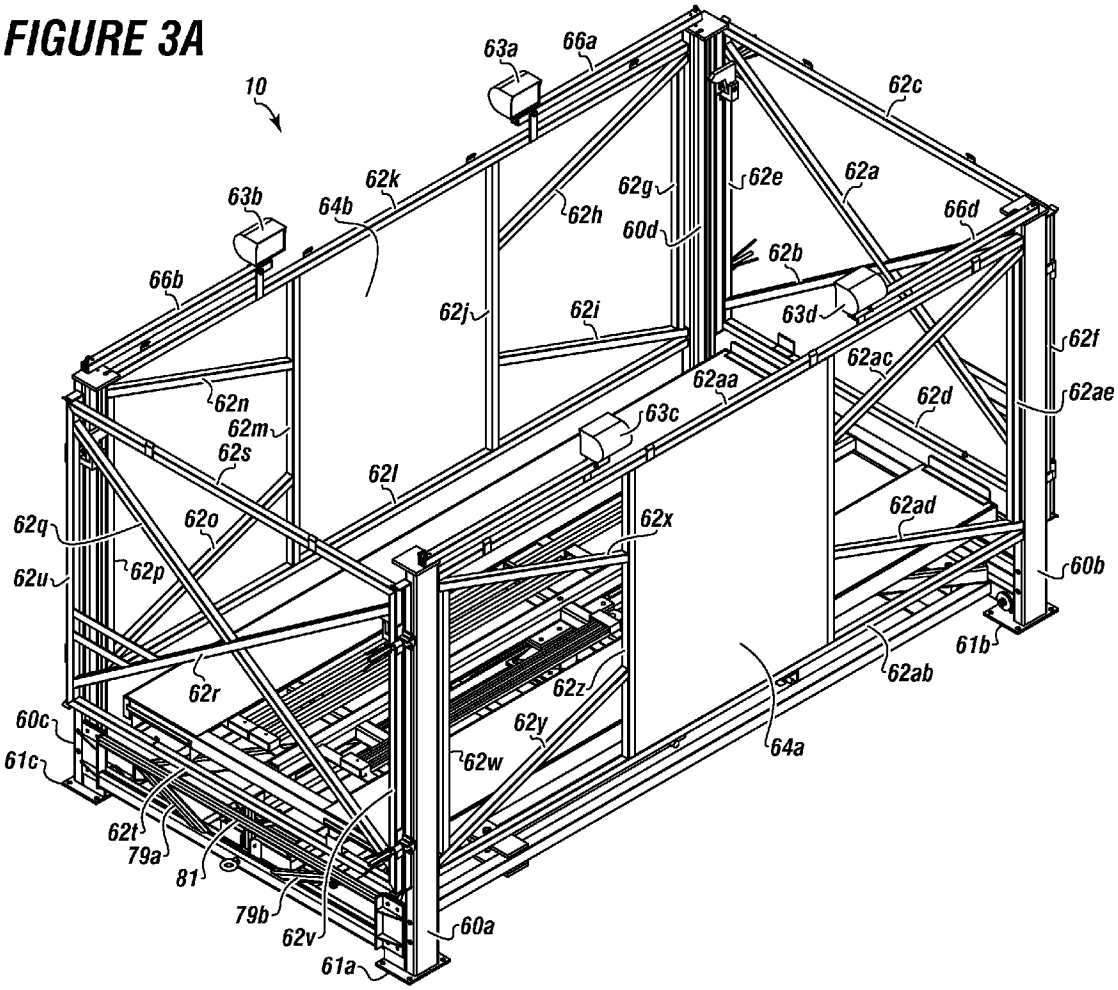
FIG. 3A depicts a vehicle display device in a lowered position.

FIG. 3A depicts the vehicle display device in a lowered position.

The vehicle display device 10 can include a plurality of legs 60*a*-60*d*. Each leg can be secured at a 90 degree angle to a corner of the frame assembly bottom. Each leg can have a length from 3 feet to 15 feet and a width from 2 inches to 18 inches. In embodiments, the legs can be solid steel. In embodiments, the legs can be rectangular in shape. Each leg can rest on a plate.

The vehicle display device 10 can include a plurality of plates 61*a*-61*c*. Each plate can have a length from 2 inches and 14 inches, a width from 2 inches to 14 inches, and a thickness from ¼ inch to 2 inches. In embodiments, each plate can be welded to a leg. In embodiments, the plates can be made from steel, wood, graphite composite, or reinforced plastic.

The vehicle display device 10 can include a plurality of surround members 62*a*-62*ae* connected between at least one of: a leg and another surround member. Once connected, the plurality of surround members can form a surround structure that encircles the frame assembly top.

The surround members can be connected together, such as by welding or with removable replaceable bolts and nuts. In embodiments, each surround member can be made from steel or a rigid alloy. In embodiments, each surround member can have a length from 2 inches to 20 feet and a width from 1 inch to 6 inches.

The vehicle display device 10 can include at least one electronic message display 64*a* and 64*b* physically connected to at least one of: at least one surround member and at least one vehicle pad. In embodiments, the electronic message display can be attached with a hinge.

In embodiments, each electronic message display can be electrically connected with the control box. In embodiments, each electronic message display can be a light emitting diode (LED) display, a neon display, a liquid crystal display, or a fiber optic display.

Each electronic message display can be in communication with a processor which can communicate with a network, creating quickly changeable signs modifiable from a remote location.

The vehicle display device 10 can include a plurality of lights 63*a*-63*d*. Each light can be configured for illuminating the vehicle on the vehicle pads. Each light can be connected to the power supply. In embodiments, the lights can be tilted. The lights can be fluorescent, LED or halogen lights. In embodiments the lights can use from 1 watt to 5000 watts and from ¼ amp to 20 amps.

Each light can be mounted to an arm 66*a*-66*d*. Each arm can be mounted to a leg 60*a*-60*d*. In embodiments, each arm can pivot or swivel on the leg.

In embodiments, the vehicle display device 10 can include a plurality of diagonal end braces 79*a* and 79*b* on two opposing sides. Each diagonal end brace can connect to a horizontal end brace 81 that can connect between a pair of legs 60*a* and 60*c*.

Figure 3B:
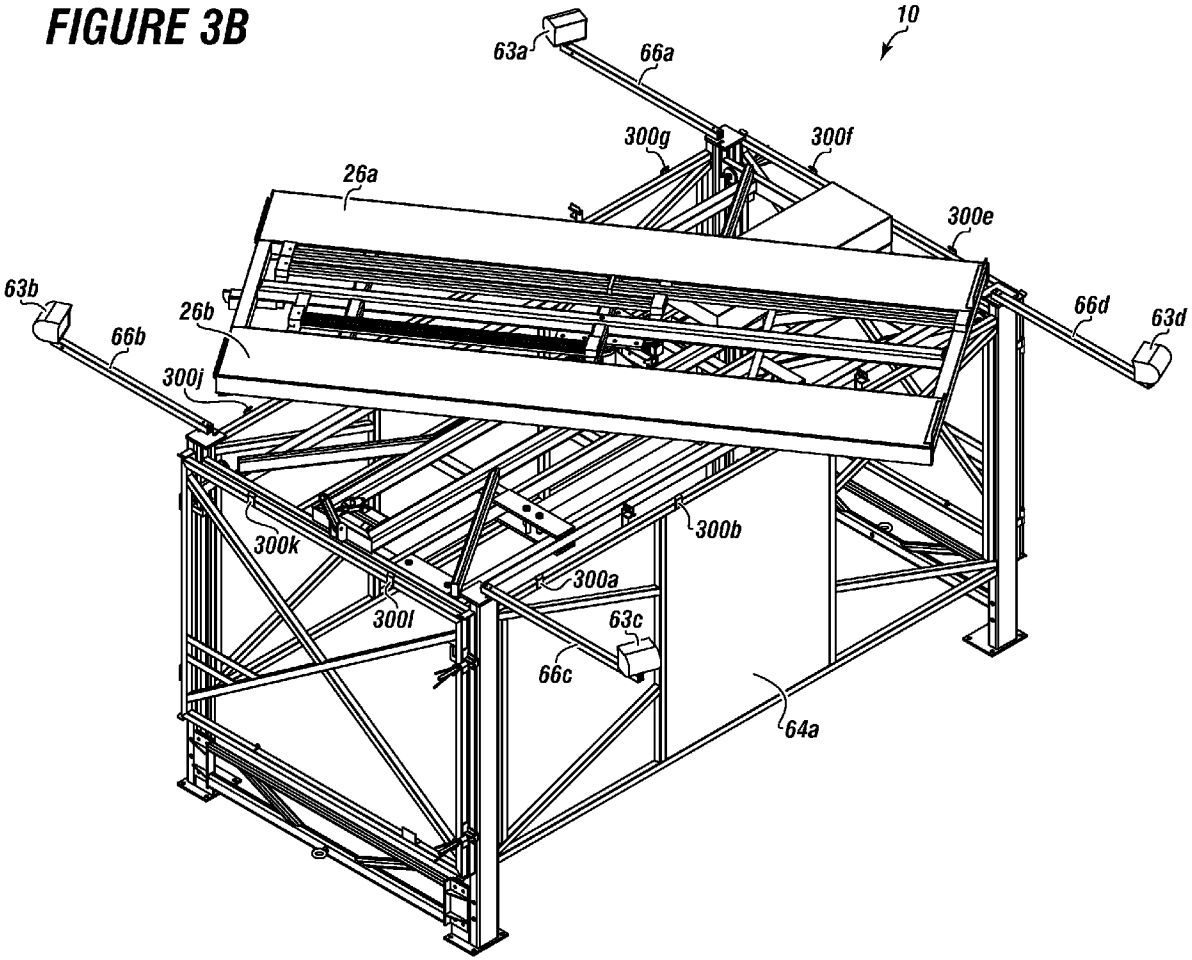
FIG. 3B depicts the vehicle display device in a raised position.

FIG. 3B depicts the vehicle display device in a raised position.

The vehicle display device 10 can include a plurality of connectors 300*a*-3001 disposed on surround members. Each connector can be configured to help secure a non-electrical banner, sign or flag.

When the vehicle display device 10 is in a raised position, the vehicle pads 26*a* and 26*b* can be rotated above the surround structure formed from the connected surround members.

When the vehicle display device 10 is in a raised position, the arms 66*a*-66*d* can be pivoted away from the surround members allowing the lights 63*a*-63*d* to provide illumination for a vehicle on the vehicle pads.

The electronic message display 64*a* can present messages in real time for a color coordinated display at a car dealership. For example, when a plurality of vehicle display devices are used, some can show red, some can show white, and some can show blue, creating a patriotic image.

FIG. 4 depicts a cross sectional view of the turntable 40 mounted in the frame 42 of the frame assembly bottom.

FIG. 5 depicts a diagram of the control box.

The control box 53 can include a switching means 56 which can be electrically connected to a hydraulic pump 55. The control box 53 can also include a power supply 54 which can be connected to the hydraulic pump 55.

The control box 53 can include and a processor 70 in communication with a data storage 72. The processor can be a computer. The processor can be in communication with a network. The network can be the internet, a global area network, a local area network, a satellite network or a cellular network.

The control box 53 can include a data storage 72 with a non-transitory computer medium for storing computer instructions.

The data storage 72 can include computer instructions 74 to receive and store a message for display on the electronic message display.

The data storage 72 can include computer instructions 76 to present at least one message on the electronic message display.

The data storage 72 can include computer instructions 78 to receive at least one message from at least one client device connected to the network, wherein the message contains at least one of: an image or text.

The data storage 72 can include computer instructions 80 for selectively actuating at least one of the lights.

Figure 6:
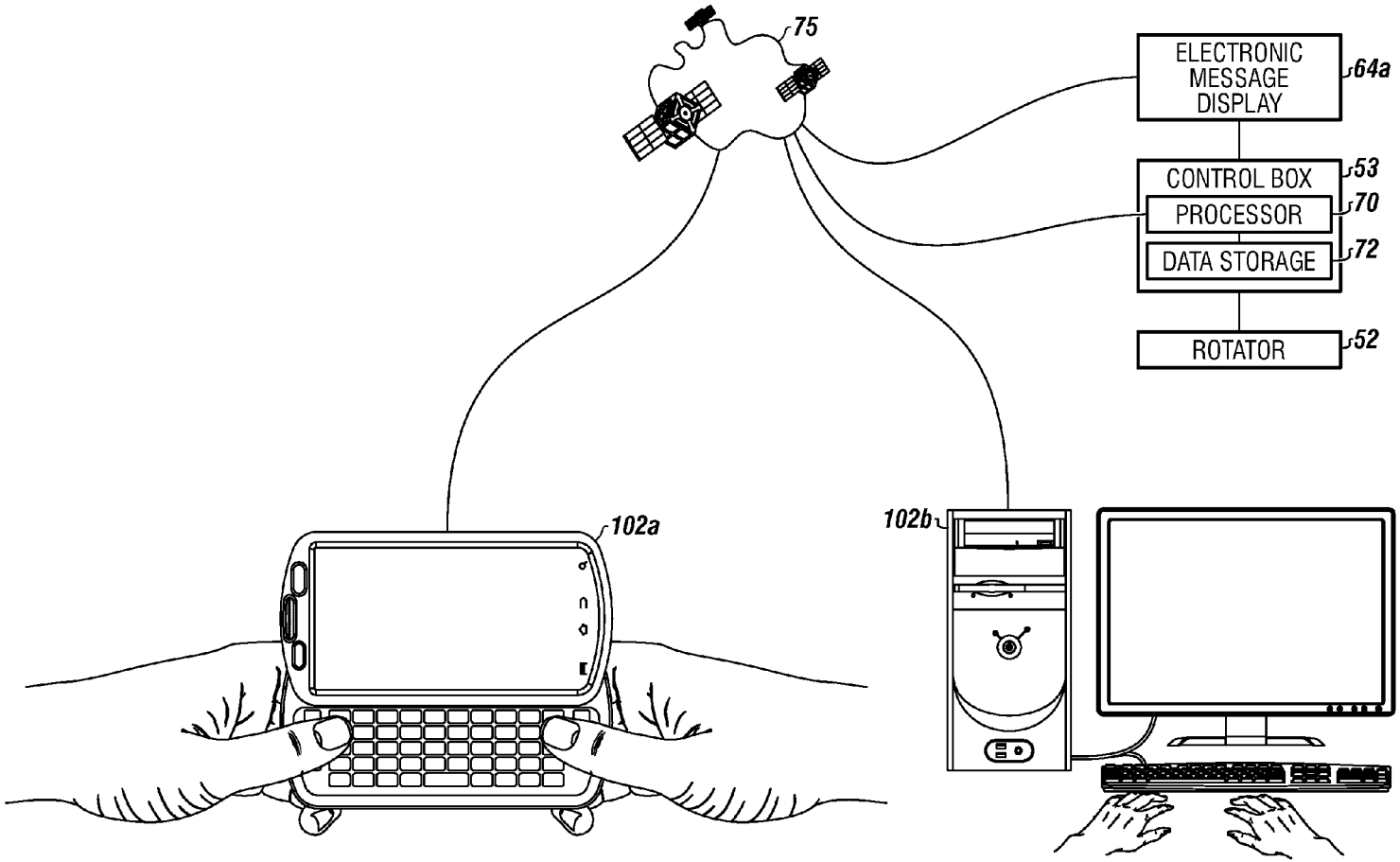
FIG. 6 depicts a diagram of network communications.

FIG. 6 depicts a diagram of network communications.

The electronic message display 64*a* can be in communication with the network 75 and the control box 53. The control box can be in communication with the electronic message display 64*a* and the rotator 52. The control box can include a processor 70 in communication with the network 75 and a data storage 72. The client devices 102*a* and 102*b* can be in communication with the network 75.

The processor 70 can receive a message from at least one client device 102*a* and 102*b*, which can be a computer or a cell phone, via the network 75. The message can cause the control box to activate the pistons to move the frame assembly top from a lowered position to a raised position and then rotate the turn table which supports a vehicle resting on the vehicle pads while simultaneously displaying a message, which has been supplied from a client device, on the electronic message display.

In embodiments, the vehicle display device can have traverse bottom supports with a length equidistantly extending beyond the longitudinal bottom supports.

In embodiments, the turntable can be configured to slip when counter torque on the turntable is above a predetermined value.

In embodiments, the hydraulic lifting means can be replaced with a lift system selected from the group consisting of: a scissor lift, a center lift, a jack, a block and tackle lift, a rack and pinion lift, and the like.

In embodiments, the vehicle display device can have a pair of leveling arms connected thereto, wherein the leveling arms are configured to level the vehicle display device when deployed.

In embodiments, the vehicle display device can include a method for displaying a rotating vehicle while providing a message with the steps of positioning a vehicle display device; positioning two ramps adjacent the vehicle pads, wherein the two ramps are adapted to allow the vehicle to be positioned on the vehicle pads; driving the vehicle over the ramps onto the vehicle pads and securing the bumper to the vehicle display device; removing the ramps into the display; elevating the vehicle; initiating messages to the electronic message display; and actuating the turntable allowing for three hundred and sixty degrees of rotation of the vehicle.

While these embodiments have been described with emphasis on the embodiments, it should be understood that within the scope of the appended claims, the embodiments might be practiced other than as specifically described herein.

What is claimed is:

1. A vehicle display device configured to fit in a single car parking space without the need for outriggers, the vehicle display device comprising:

a. a frame assembly top comprising:
   (i) a plurality of longitudinal top supports connected between a first end member and a second end member;
   (ii) a plurality of traverse top supports extending across the plurality of longitudinal top supports;
   (iii) a top frame plate mounted between at least one of the plurality of traverse top supports and at least one of the plurality of longitudinal top supports; and
   (iv) a pair of vehicle pads mounted between the first end member and the second end member, over and in parallel with the plurality of longitudinal top supports and over the plurality of traverse top supports;

b. a plurality of legs, wherein each leg is mounted at an angle 90 degrees from a plane of the frame assembly top, and wherein the plurality of legs are configured to contain the frame assembly top between the plurality of legs;

c. a frame assembly bottom comprising:
   (i) a plurality of longitudinal bottom supports mounted between a pair of traverse bottom supports;
   (ii) a turntable for mounting to the top frame plate, wherein the turntable is secured centrally to a frame mounted over the plurality of longitudinal bottom supports and connected between the pair of traverse bottom supports;
   (iii) a hydraulic lifting means for raising and lowering the frame assembly top apart from the frame assembly bottom between the plurality of legs;
   (iv) a rotator connected to the turntable for rotating the turntable;
   (v) a control box connected to the frame, wherein the control box is in communication with the rotator, the control box further comprising:
      1. a power supply; and
      2. a hydraulic pump;

d. a switching means electrically connected to the hydraulic pump and the rotator;

e. a hydraulic reservoir of hydraulic fluid fluidly connected to the hydraulic pump;

f. a plurality of surround members connected between at least one of: a leg and another surround member, wherein the plurality of surround members surround the frame assembly top forming a surround structure;

g. an electronic message display, wherein the electronic message display is physically connected to at least one of at least one surround member and at least one vehicle pad, and wherein the electronic message display is electrically connected with the control box; and h. a processor for controlling the electronic message display, wherein the processor is in communication with a data storage with non-transitory computer medium, the non-transitory computer medium having:

(i) computer instructions to receive and store at least one message for display on the electronic message display; and (ii) computer instructions to present the at least one message on the electronic message display; and wherein the hydraulic lifting means moves the frame assembly top from a lowered position adjacent the frame assembly bottom to a raised position apart from the frame assembly bottom and then rotates the frame assembly top when a vehicle is resting on the pair of vehicle pads while simultaneously displaying the at least one message on the electronic message display.

2. The vehicle display device of claim 1, wherein the hydraulic lifting means comprises a pair of pistons mounted between a pair of the plurality of longitudinal bottom supports, wherein the pair of pistons pulls in and releases a plurality of cables, and Wherein each cable is connected to a top of each leg and running between a plurality of pulleys secured to each leg allowing the plurality of cables to simultaneously raise and lower the frame assembly top between the plurality of legs when the pair of pistons extend and retract.

3. The vehicle display device of claim 1, wherein the processor is connected to a network.

4. The vehicle display device of claim 1, wherein the electronic message display is a light emitting diode display.

5. The vehicle display device of claim 1, comprising a plurality of electronic message displays mounted to different surround members.

6. The vehicle display device of claim 1, wherein each traverse bottom support has a length extending beyond the plurality of longitudinal bottom supports equidistantly.

7. The vehicle display device of claim 1, further comprising a plurality of diagonal supports connected between one of the plurality of longitudinal bottom supports and the frame.

8. The vehicle display device of claim 1, comprising a plurality of lights, wherein each light is mounted to an arm, wherein each arm is mounted to one of the plurality of legs, wherein each light is connected to the power supply, and wherein each light is configured for illuminating a vehicle supported on the pair of vehicle pads.

9. The vehicle display device of claim 8, wherein the switching means is electrically connected to at least one of the lights for selectively actuating at least one of the lights.

10. The vehicle display device of claim 1, wherein the data storage contains computer instructions to receive the message from at least one client device connected to the network, wherein the message contains an image, a text, or combinations thereof.

11. The vehicle display device of claim 1, further comprising a plurality of connectors disposed on the plurality of surround members, wherein each connector is configured to secure a non-electrical banner, a sign, a flag, or combinations thereof.

12. The vehicle display device of claim 1, wherein the turntable is configured to slip when counter torque on the turntable is above a predetermined value.

13. The vehicle display device of claim 1, further comprising a plurality of diagonal end braces, wherein each diagonal end brace is connected to a horizontal end brace connected between a pair of the plurality of legs.

* * * * *